US006698024B2

(12) United States Patent
Graves et al.

(10) Patent No.: US 6,698,024 B2
(45) Date of Patent: Mar. 2, 2004

(54) MODULAR FRONT OPENING BODY ARMOR

(75) Inventors: Ronda Renee Graves, Coconut Creek, FL (US); Sandra L. Hatfield, Lighthouse Point, FL (US); Edward C. Levigne, Coconut Creek, FL (US)

(73) Assignee: Point Blank Body Armor, Inc., Oakland Park, FL (US)

( * ) Notice: Subject to any disclaimer, the term of this patent is extended or adjusted under 35 U.S.C. 154(b) by 0 days.

(21) Appl. No.: 10/205,103

(22) Filed: Jul. 25, 2002

(65) Prior Publication Data

US 2003/0066116 A1 Apr. 10, 2003

Related U.S. Application Data

(60) Provisional application No. 60/311,640, filed on Aug. 10, 2001.

(51) Int. Cl.[7] ..... F41H 1/02

(52) U.S. Cl. ..... 2/2.5; 2/463; 2/464

(58) Field of Search ..... 2/2.5, 102, 455, 2/456, 459, 461, 462, 463, 464, 465, 466, 467, 468; 428/340, 911

(56) References Cited

U.S. PATENT DOCUMENTS

| | | | | |
|---|---|---|---|---|
| 4,864,656 | A | 9/1989 | Neese | |
| 5,060,314 | A | * 10/1991 | Lewis | 2/2.5 |
| 5,771,489 | A | 6/1998 | Snedeker | |
| 5,799,329 | A | * 9/1998 | Hauschild | 2/102 |
| 5,926,842 | A | 7/1999 | Price et al. | |
| 5,970,513 | A | 10/1999 | Kocher | |
| 6,029,270 | A | 2/2000 | Ost et al. | |
| 6,047,399 | A | 4/2000 | Bachner, Jr. | |
| 6,131,198 | A | 10/2000 | Westrick | |
| 6,151,710 | A | 11/2000 | Bachner, Jr. | |
| 6,185,738 | B1 | 2/2001 | Sidebottom | |
| 6,266,819 | B1 | 7/2001 | Bachner, Jr. | |

* cited by examiner

*Primary Examiner*—Gary L. Welch
(74) *Attorney, Agent, or Firm*—Greenberg Traurig LLP

(57) ABSTRACT

Modular front opening body armor protects the user from edged weapons, sharp objects, and ballistic threats. Additionally, the modular front opening body armor can be fitted with various pieces of protective gear based on the user's expected environment, and the body armor can be adjusted for proper protection and comfort without reducing protection for the user.

11 Claims, 6 Drawing Sheets

MODULAR FRONT OPENING BODY ARMOR

CROSS REFERENCES TO RELATED APPLICATIONS

This application claims the benefit under 35 U.S.C. 119(e) of U.S. Provisional Application Serial No. 60/311,640 filed on Aug. 10, 2001.

FIELD OF THE INVENTION

This invention relates to the field of body armor for protecting a user from penetration.

BACKGROUND OF THE INVENTION

Throughout recorded history various types of materials have been used by people to protect themselves from injury in combat and other dangerous situations. At first, protective clothing and shields were made from animal skins. As human technology advanced these protective garments became more advanced and were made of thin metal plates inserted into panels in a vest or sewn into densely woven materials, such as Loden cloth woven underwater to contract the fibers during the weaving process. In the early centuries the typical soldier at the infantry level wore a quilted jacket reinforced with pieces of metal, bone or leather. As civilizations became more advanced, wooden shields and then metal shields came into use.

In the 8th century, chain mail appeared in the equipment of Norsemen. Mail remained the standard protection for more than 400 years. Eventually, metal was also used as "clothing", in what we now refer to as the suit of armor associated with the knights of the Middle Ages. By the 15th century suits of arms composed entirely of metal plate armor were in general use for mounted knights. Such suits weighed about 60 pounds (27 Kgs). As weapons improved, the knight correspondingly increased the weight of his armor and subsequently lost more of his mobility.

With the advent of firearms, most of the traditional protective devices were no longer effective. In fact, the only real protection available against firearms were constructed barriers, such as stone or masonry walls, as well as natural barriers such as rocks, trees, and ditches. Among the items sent from London, England to Jamestown, Va. in 1622 were armored jackets called brigantines. However, during the 17th century reinforced armor became increasingly ineffectual and additionally unbearable to wear for any length of time and was discarded piece by piece.

One of the first recorded instances of the use of soft armor was by the medieval Japanese, who used armor manufactured from silk. Although the first United States Law Enforcement Officer to lose his life in the line of duty, U.S. Marshall Robert Forsyth, was shot and killed in 1794, it was not until the late 19th century that the first use of soft armor in the United States was recorded. At that time, the military explored the possibility of using soft armor manufactured from silk. The project even attracted congressional attention after the assassination of President William McKinley in 1901. But while the garments were shown to be effective against low-velocity bullets, traveling at 400 feet per second or less, they did not offer protection against the new generation of handgun ammunition being introduced, at that time that traveled at velocities of more than 600 feet per second. This along with the prohibitive cost of manufacturing the garment made the concept unacceptable. Armor of this type was said to have been worn by Archduke Francis Ferdinand of Austria when he was shot in the head, thereby precipitating World War I.

The bullet-proof vest was popularized during the prohibition era by FBI crime fighters and publicized by the newly emerging film industry of the 1920's and 1930's. One of the first documented instances where a bullet-proof vest was demonstrated for use by law enforcement officers is detailed in the Apr. 2, 1931 edition of the Washington, D.C., Evening Star, where a vest was demonstrated to members of the Metropolitan Police Department. However, none of these designs proved entirely effective or feasible for law enforcement or correction use.

The next generation of ballistic vests was introduced during World War II. The "flak jacket", constructed of ballistic nylon, provided protection primarily from low velocity munitions fragments and was ineffective against most pistol and rifle threats. These vests were also very cumbersome and bulky, and were restricted primarily to military use.

It was not until the late 1960's that new fibers were discovered that made today's modern generation of concealable body armor possible. Concurrently, the 1960's witnessed a dramatic rise in fatalities of law enforcement officers in the US. From 1966 to 1971, the number of law enforcement officers killed each year in the line of duty more than doubled, from 57 to 129. Concerned by this rapid increase in officer fatalities and recognizing that a majority of the homicides were inflicted with handguns, the National Institute of Law Enforcement and Criminal Justice, predecessor of the National Institute of Justice (NIJ), initiated a research program to investigate development of a lightweight body armor that on-duty police could wear full time.

This investigation readily identified new materials that could be woven into a lightweight fabric with excellent ballistic-resistant properties. Following initial laboratory research, the agency concluded that the objective of producing body armor suitable for full-time police use was achievable. In a parallel effort, the National Bureau of Standards developed a performance standard that defined ballistic-resistant requirements for police body armor. The National Bureau of Standards was a part of the NIJ Technology Assessment Program, which today is known as the National Law Enforcement and Corrections Technology Center (NLECTC).

Since the 1960's, when concealable body armor was introduced, the technology for ballistic materials has improved considerably to the high standards of modern day soft body armor demanded by today's crime fighters. Of all the equipment developed and evaluated in the 1970's by NIJ, one of its most significant achievements was the development of body armor that employed DuPont's Kevlar® ballistic fabric.

The evolution of powerful, high capacity semi-automatic weapons has created an increased need for state-of-the-art body armor.

SUMMARY OF THE INVENTION

The present invention is a modular front opening body armor that allows attachment of various pieces of protective equipment to protect a user from penetration by blades, sharp objects, and ballistic weapons.

BRIEF DESCRIPTION OF THE DRAWING

A more complete understanding of the present invention may be obtained from consideration of the following description in conjunction with the drawing, in which.

DETAILED DESCRIPTION OF VARIOUS ILLUSTRATIVE EMBODIMENTS

Even as crime rates decline, ballistic threats facing law enforcement officers, corrections professionals, and individuals involved in tactical operations is increasing everyday. With this increase in threat comes a greater need for individuals to wear superior body armor protection.

The present invention is a modular front opening body armor designed in a variety of styles including a jacket, coat, shirt and vest style, opening down the front, with straps, and hooks and loops on the sides for adjustability. The ballistic material in the present invention protects the user against spike and edged blade weapons at various levels, as determined by the type and quantity of materials secured on the interior of the front opening body armor, by preventing blade from penetrating the modular front opening body armor and reaching the user. Additionally, the ability to prevent the penetration of low speed sharp objects, such as knives and edged weapons, can also have applications in hazardous work environments were sharp objects and flying objects can be encountered.

Additionally, the body armor protects the user from ballistic threats by stopping bullet penetration; and minimizing blunt trauma to the body. A ballistic threat being a projectile, such as a bullet, fired at the user. Blunt trauma is the transfer of the kinetic energy from the bullet to the body, when the bullet is stopped by the body armor.

The ballistic materials described herein defeats the ballistic threat by causing the projectile, or bullet, to deform and thus spread its kinetic energy over a larger surface area of the material than the original diameter of the bullet. This deformation results in the bullet not being able to penetrate the ballistic material. The dissipation of the mass and kinetic energy of the bullet results in a reduction of blunt force trauma to the individual. The larger the area over which the energy of the bullet is distributed, the less blunt trauma will be transferred to the user at the point of impact, and increased protection to the user will be provided by the body armor. Additionally, because of its construction, the blunt force of the bullet is absorbed and distributed throughout the body armor.

Furthermore, reducing blunt trauma to a user save lives, since it not only prevents internal injury, but also minimizes incapacitation during the initial hit, thereby allowing the user to respond immediately in a high-threat situation.

Figure 1:
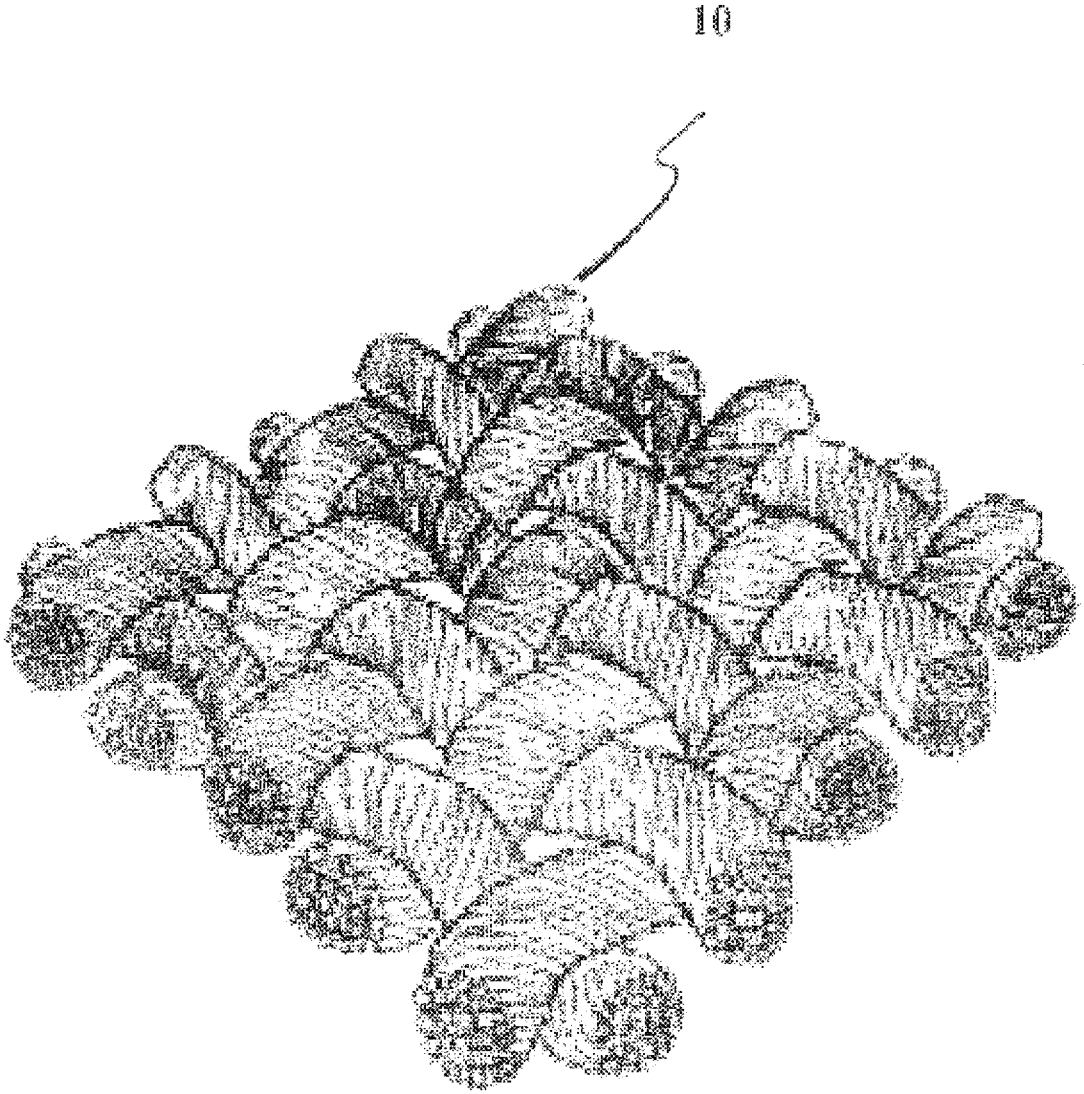
FIG. 1 is an illustration of ballistic material comprising woven ballistic fibers.

Referring to FIG. 1 there is shown one embodiment of a ballistic material 12 comprising ballistic fibers 10 woven into material used in the present invention. It can be seen that the ballistic fibers 10 are composed of ballistic filament 14 where the ballistic filaments are twisted like a spring in the ballistic fiber 10. Similar to a spring, the ballistic filaments 14 have an amount of "give" when they are impacted by a bullet. The ballistic fibers 10 are aligned next to each other and additional ballistic fibers 10 are woven at approximately a right angle. All the ballistic fibers 10 are held in place by a flexible resin. The ballistic material 12 is typically laminated between two thin sheets of film (not shown). When impacted by a projectile such as a bullet, this orientation of the ballistic fibers 10 provides for uniform energy dispersion throughout the material using the tensile strength of the ballistic fibers 10. Additionally, this construction greatly reduces back face deformation caused by stopping a bullet, thereby reducing the effects of blunt trauma on the user. This technology is especially effective against full metal jacketed rounds. Additional layers of fibers can be added to provide additional levels of protection.

Figure 2:
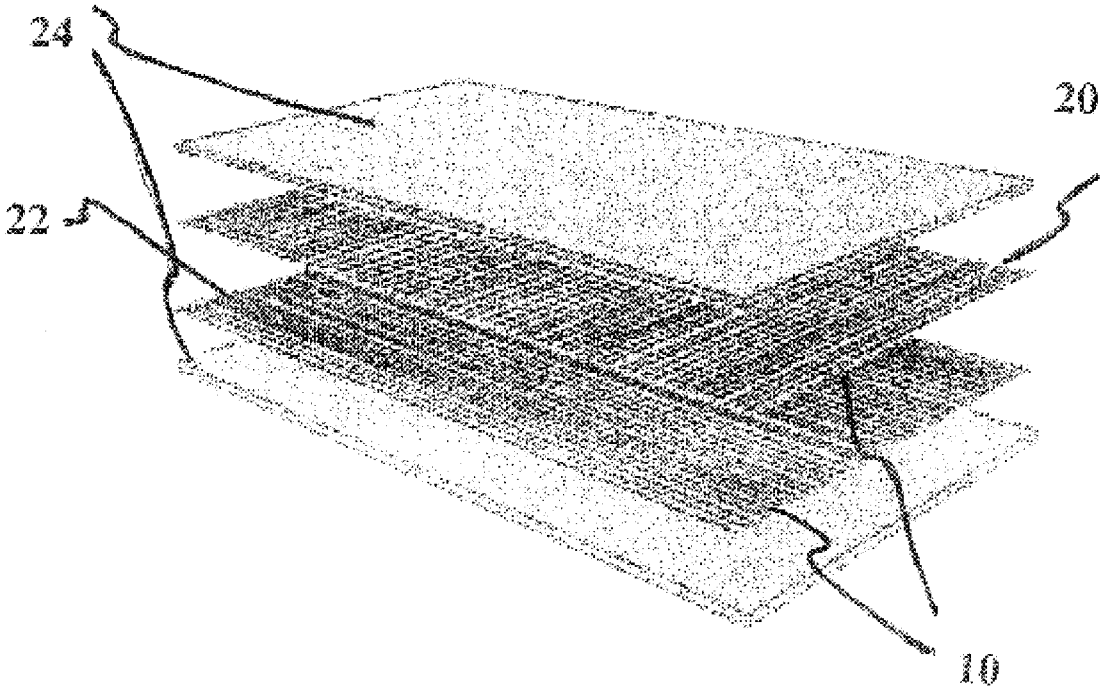
FIG. 2 is an illustration of a non-woven ballistic material.

Referring to FIG. 2 there is shown another embodiment of ballistic material. In this embodiment the ballistic fibers 10 are aligned in a first ballistic sheet 20 and secured in place such as with resin. A second ballistic sheet 22 comprising aligned ballistic fibers 10 secured such as with resin is orientated at approximately 90° to the first ballistic sheet 20. The resin in the ballistic fibers 10 prevents a bullet from pushing the fibers aside and penetrating the material. The ballistic sheets are typically laminated between two film sheets 24. While the figure shows a material with two ballistic sheets 20, 22 and two film layers 24, multiple layers of ballistic sheets and film sheets can be used to provide additional levels of protection.

Figure 3:
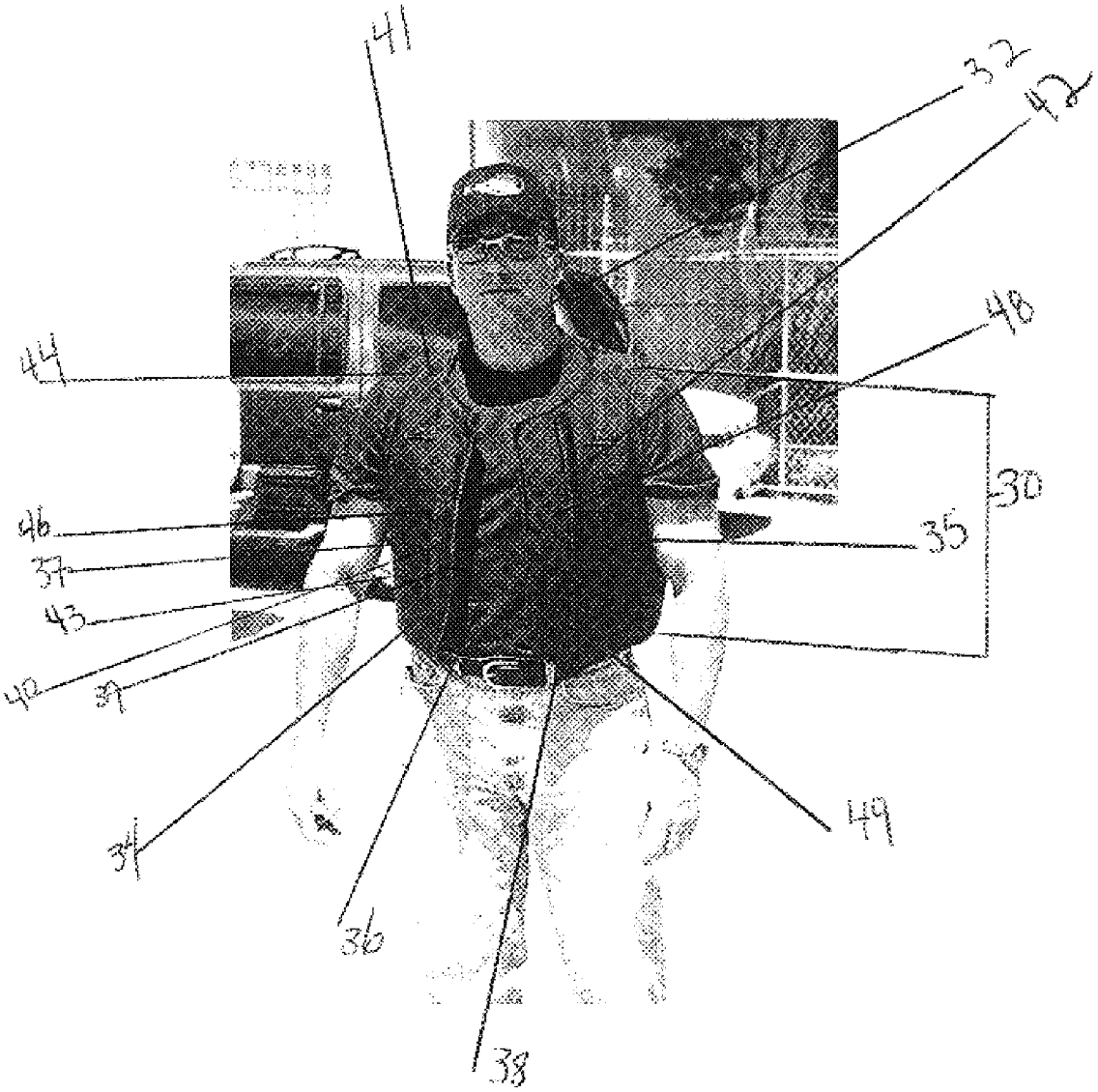
FIG. 3 is a drawing of the front of the modular front opening body armor in the open position.

Referring to FIG. 3 there is shown one embodiment of the modular front opening body armor 30 worn by a user 32. The modular front opening body armor 30 contains a ballistic material disposed between an exterior material 49 and a lining (not shown) of the vest 34. In a preferred embodiment, one of the ballistic materials as described above is used. However, the present invention is equally well suited for use with other ballistic materials depending on the environment that the user may expect to encounter. In one embodiment, the material is impervious to penetration by a knife or similar sharp weapon, and/or to ballistic impact such as a bullet.

A vest 34 has side sections 44, and a left front panel 35 and a right front panel 37 with respective shoulder areas 41 of front panels 35, 37 attached to a shoulder section (not shown) of a back panel (not shown) of the vest 34. The front panels 35, 37 have a front edge 39 and a side edge 43. A front opening 36 is defined as a space between the front edges 39 of the left and right front panels 35, 37. The front opening 36 is closed by the use of a front closure mechanism 38. In a preferred embodiment, the front closure mechanism 38 is a zipper, but the mechanism is equally well suited for any other device that can secure the front panels 35, 37 together, such as not limited to magnets, buttons, hook and loop system, or snaps as well as other devices known to those skilled in the art. In a preferred embodiment, the front opening 36 of the vest 34 is constructed such that there is a protective flap 48 directly behind the front closure mechanism 38 when the vest 34 is closed. The vest 34 has a flap 40 that conceals the front closure mechanism 38 from view. In one embodiment there is a hook and loop closure system on the interior of the flap 40, and a hook and loop seal 42 attached to the exterior material 49 of the vest 34, such as Velcro®. The hook and loop seal 42 hold the flap 40 closed to protect the front closure mechanism 38. Any system that secures the flap 40 to the exterior material 49 of the vest 34 can be used and would include, but not be limited to, zippers, buttons, magnets, or snaps.

The front opening 36 is designed to deceive a potential attacker camouflaging the actual functionality of the device.

If an attacker opens the flap 40 and attempts to stab the a user 32 diagonally based on the perceived weak spot in the front opening 36, protection is provides by the protective flap 48. The flap 40 is attached in the opposite direction of the protective panel 48 overlap. The flap 40 gives the perception to a potential attacker that by stabbing or shooting in a specific direction they will injure or kill the user 32. In fact the design of the front opening 36 of the vest 34 provides for the highest level of protection in the perceived vulnerable area. Additionally, the vest 34 has snaps 46, or other suitable attachment mechanism to allow for the attachment of additional protective components. Embodiments of the coupling mechanism include, but are not limited to, a mechanical apparatus or magnetic device, whereas the mechanical apparatus includes, but is not limited to, embodiments such as a zipper, hook and loop system, snaps, strap and buckle, and buttons.

Figure 4:
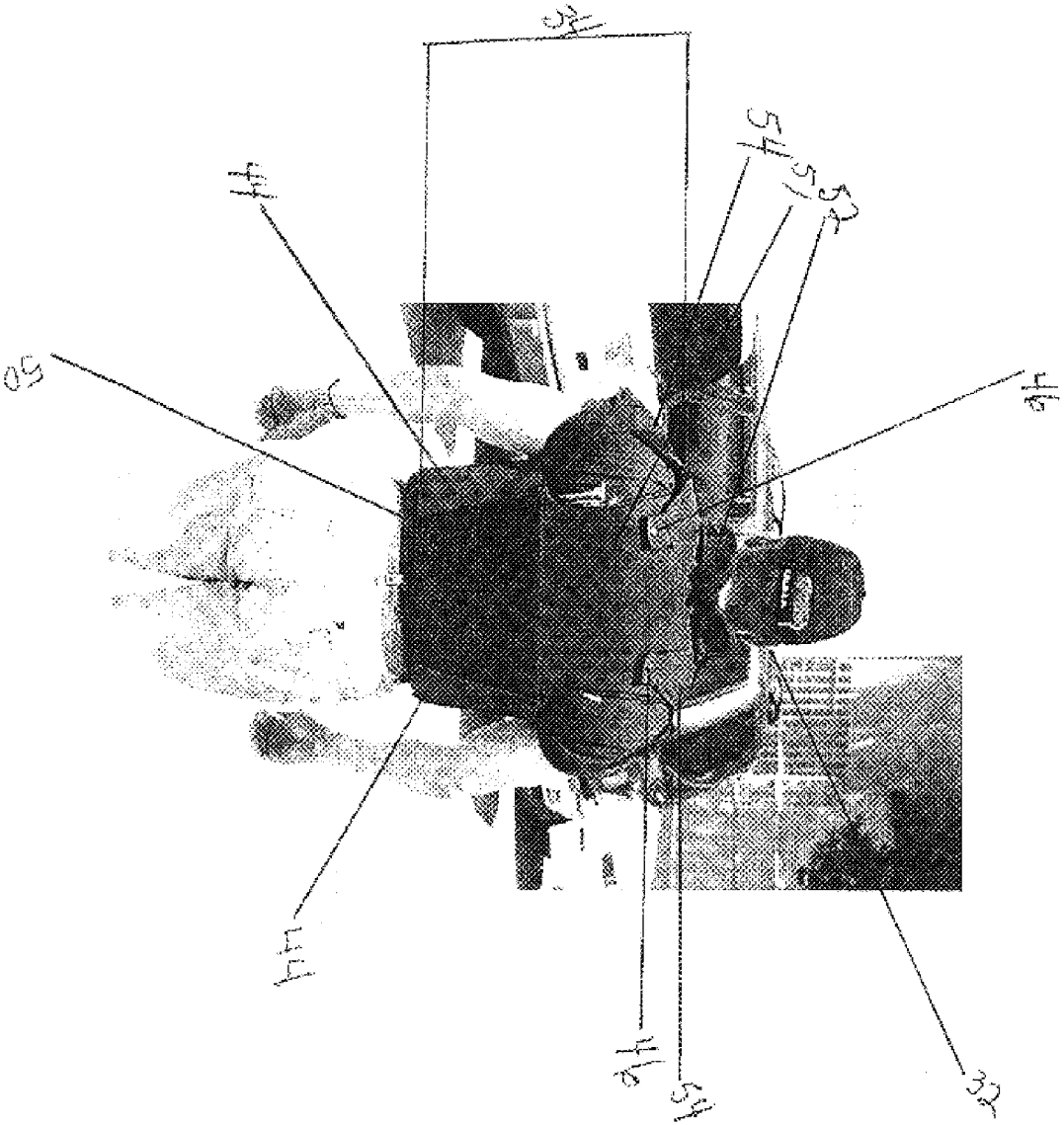
FIG. 4 is a drawing of the back of the modular front opening body armor.

Referring now to FIG. 4 where can be seen a back view of the vest 34. In one embodiment of the present invention, the back closure area 50 is on the exterior material 49 of the back panel 51 of the vest 34 as shown. The side sections 44 are shown attach to the back closure area 50. The back closure area 50 could also be positioned on the lining (not shown) at the back of the vest 34, additionally while the figure depicts two side sections 44 that can be opened, an alternate embodiment only has one side section 44 of the vest 34 which could open. While the figure shows a preferred embodiment of a hook and loop system, other devices such as magnets, snaps, zippers, or buttons could be used to adjustably attach the side 44 to the back. Also shown is a collar 52 that provides protection to the neck area of the user 32. The collar 52 contains ballistic material and can be attached to the vest 34 using any appropriate attachment mechanism. An alternate embodiment of the modular front opening body armor 30 is the incorporation of shoulder pads 54 to the shoulder area of the vest 34. The shoulder pads 54 contain ballistic material and provide protection to the shoulder area of the user 32. While the shoulder pads 54 are shown attached to the vest 34 by snaps 46, many other means for holding shoulder pads 54 to a vest 34 are equally well suitable for attaching the shoulder pads 54.

Figure 5:
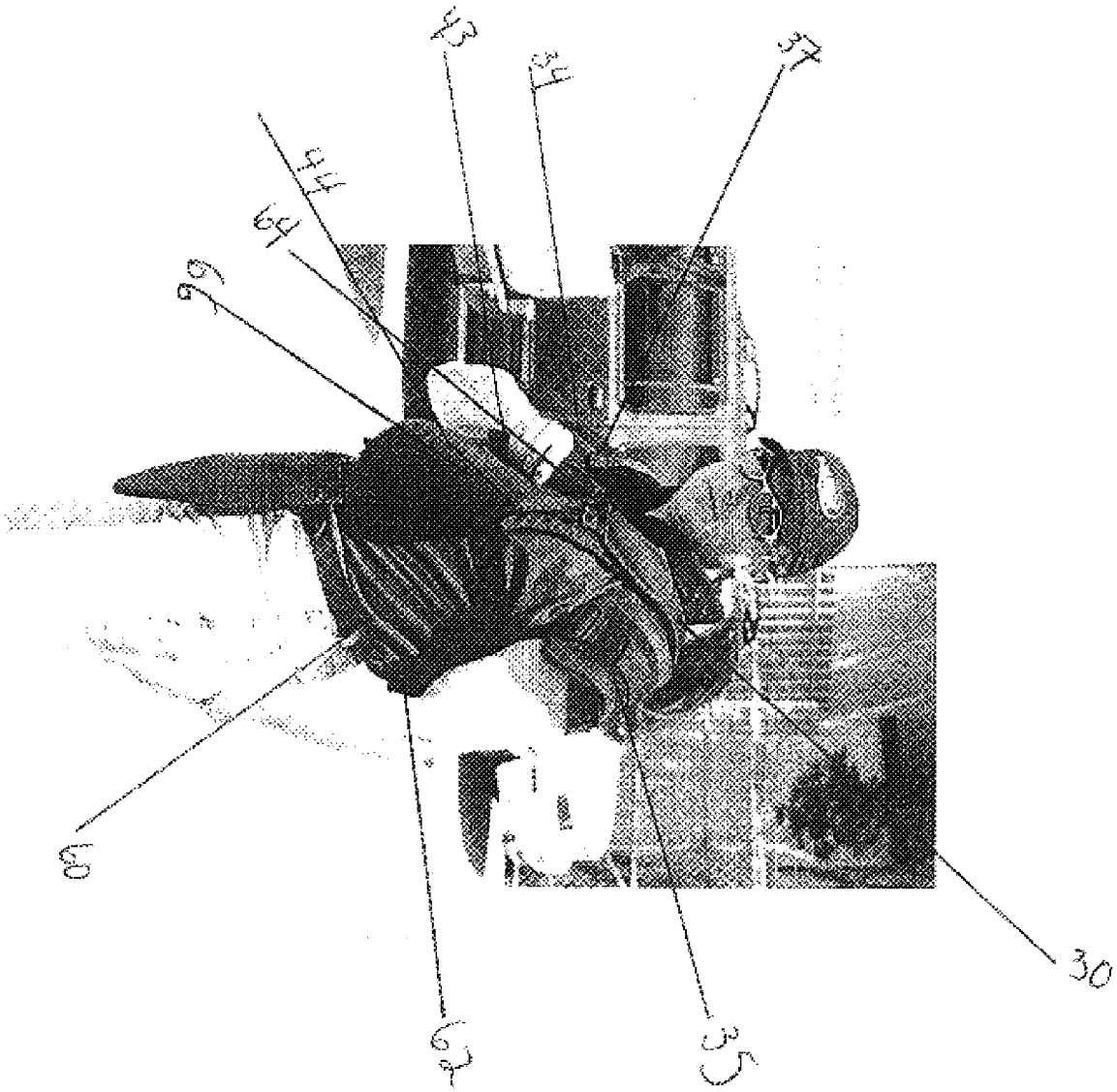
FIG. 5 is a drawing of a side of the vest in the open position.

Referring to FIG. 5 there can be seen a side view of the vest 34 with the side section 44 open. In one embodiment of the modular front opening body armor 30 both side sections 44 of the vest 34 can open. The side opening 60 is defined as the space between the side edge 43 of the front panel 35 and the back edge 62 of the back panel 49 of the vest 34. The side opening 60 is closed by a side closing mechanism 64, which can be hook and latch, buttons, zippers, buckles, snaps magnets as well as other devices known to those skilled in the art. In one embodiment of the present invention the side opening 60 is on both the left and right side of the vest 34, however, the present invention is equally well suited for use with only one side opening 60 or with multiple side openings 60. In one embodiment, the vest 34 uses hook and latch closure system for the side closing mechanism 64. The closure system can also be a zipper, strap and buckle, snaps, magnets and buttons as well as other devices known to those skilled in the art. The side sections 44 are held closed by the back closure area 50 located on the exterior material 49 on the back of the vest 34. Multiple alternatives exist for a side closing mechanism 64 as long as it securely closes the side section 44 of the vest 34, provides that the front panel 35, 37 overlaps the back panel 49, and provides protection for the user 32. The vest 34 is held securely to the user 32 by a strap 66 that attaches to a front panel 35, 37 of the vest 34 and the back panel 49 of the vest 34.

Some of the advantages of the present design of the modular front opening body armor 30 include: the vest 34 does not have to be slipped on (pulled over) over the user's head; the vest 34 can be donned and doffed more expediently; the vest 34 allows for easy removal in case of a medical emergency or emergency care of the user 32, without having to move or roll over the user 32; the vest 34 can be removed by another individual without moving the user 32; rapid removal of the vest 34 can be accomplished during exigent circumstances by opening the front opening 36 and releasing the Velcro® on the side sections 44; and, the vest 34 can be removed by the user 32 with various mobility techniques.

Figure 6:
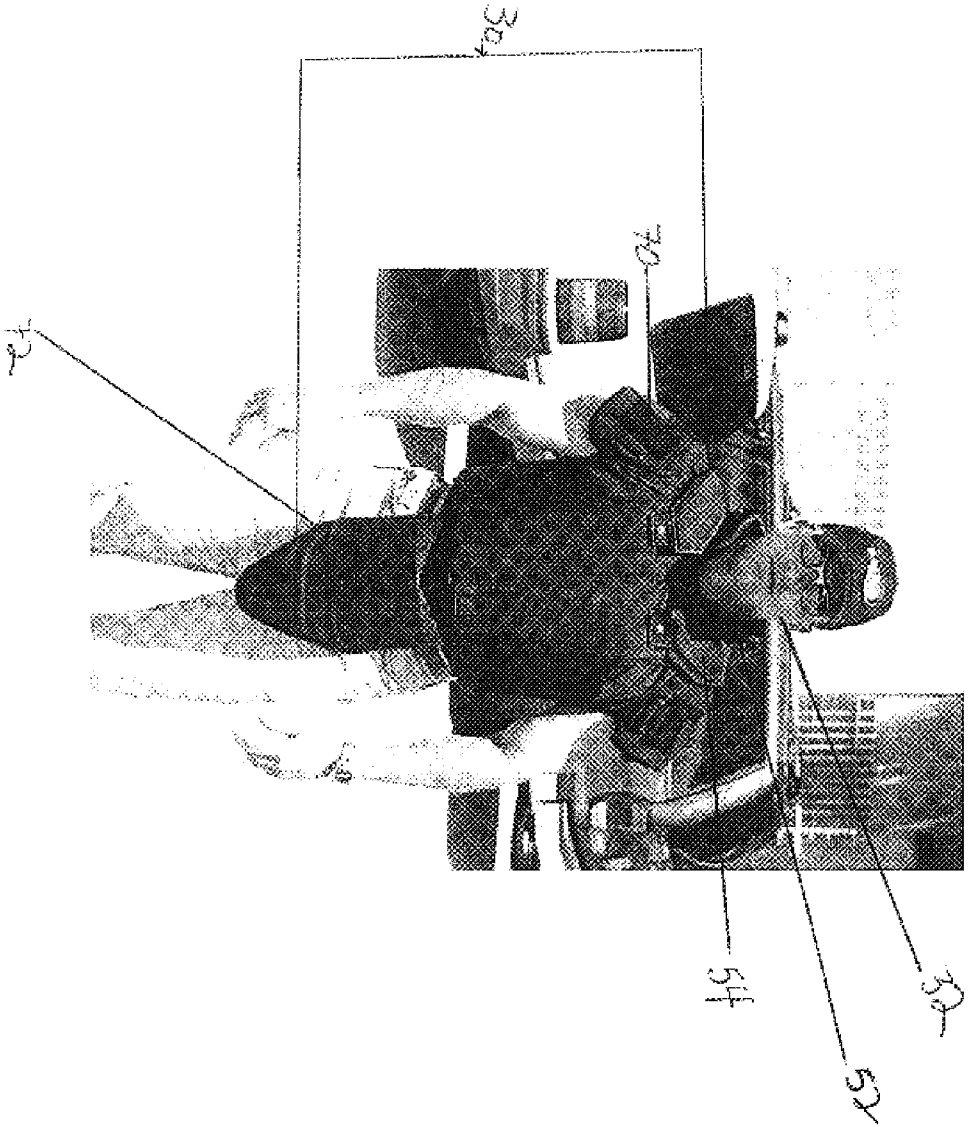
FIG. 6 is a drawing of the modular front opening body armor having a collar, shoulder pads, groin protector, and arm pads have been added.

Referring to FIG. 6 there is shown the front of the modular front opening body armor 30 with additional protective attachments. In addition to the collar 52 and shoulder pad 54, the modular front opening body armor 30 can be equipped with other features such as arm pads 70 containing ballistic material that provide protection to the arms of the user 32, a groin protector 72 that contains ballistic material, as well as other extension. The various pieces of protective equipment are attached to the vest 34 with a coupling mechanism. Embodiments of the coupling mechanism include, but are not limited to, a mechanical apparatus or magnetic device, whereas the mechanical apparatus includes, but is not limited to, embodiments such as a zipper, hook and loop system, snaps, strap and buckle, and buttons.

When selecting body armor for full-time routine use by an officer, comfort is a very major factor. Body armor that is set aside or relegated to the trunk of a police cruiser is of no benefit to the user. Two implicit fundamental factors in comfort are fit and heat discomfort. Fit being defined as mobility and weight distribution of the body armor. Due to the present invention's design that allows different pieces to be added or removed, a user can easily attach only those pieces that are essential under the circumstances. This unique ability minimizes the amount of weight being carried by the user, while maximizing mobility and flexibility. Tests conducted by law enforcement officers during normal shifts identified characteristics and features that have improved the comfort of the present invention's design. Additionally, the modular feature of the modular front opening body armor 30 allows the user 32 to remove unnecessary components and maximize the amount of skin exposed for heat dissipation. Furthermore, since the side sections 44 can be attached to the back of the vest 34 in a continuous range of positions, the user 32 can adjust the side sections 44 so that optimal and comfortable fit is achieved. As the side sections 44 and the back of the vest 34 contain ballistic material, a user will not sacrifice protection by adjusting the vest 32 for optimal comfort and fit.

The design of the modular front opening body armor 30 allows for increased flexibility and mobility of the user which in turn allows the user 32 to perform additional and more finite movements than are currently allowed in the Tactical Style Vests which are traditionally made of Titanium, Steel Alloys, and/or other metallic substances.

In addition to those features listed above the modular front opening body armor 30 is modular and convertible from a Tactical Style to a Concealable Style simply by removing sections such as the arm pads 70, groin protector 72, collar 52, and shoulder pads 54. The different protective components can be worn in different combinations depending on the threat that the user expects to encounter.

Numerous modifications and alternative embodiments of the invention will be apparent to those skilled in the art in view of the foregoing description. Accordingly, this description is to be construed as illustrative only and is for the purpose of teaching those skilled in the art the best modes of carrying out the invention. Details of the structure may be varied substantially without departing from the spirit of the invention and the exclusive use of all modifications, which will come within the scope of the appended claims, is reserved.

We claim:

1. Modular body armor for protecting a user from penetration of low speed sharp objects including knives, edged blade weapons and spikes comprising:

an adjustable vest having a back panel, a right front panel, and a left front panel, a front opening defined as a space between the left front panels and the right front panel, and at least one side opening defined as the space between the back panel and one of the front panels wherein the vest can be adjusted to fit the user and provide ballistic protection, the back panel, the right front panel and the left front panel each containing ballistic material; and at least one coupling mechanism for coupling at least one piece of protective equipment to the vest, the protective equipment containing ballistic material;

the left front panel and the right front panel each further comprise a front edge, a side edge, and a shoulder area;

the back panel further comprises a back edge and a shoulder section, wherein the shoulder area of the front panels are attached to the shoulder section of the back panel;

the front opening having an open position and a closed position further defined as a front space between the front edge of the right front panel; and a front closure mechanism, wherein the front opening is closed by securing the fright front panel and the left front panel together using the front closure mechanisim;

the front opening is constructed such that there is a protective flap directly behind the front closure mechanism when the vest is closed and a flap that conceals the front closure mechanism from view when the vest is closed, wherein the flap is attached in the opposite direction of the protective flap so as to curl around the protective flap.

2. The modular body armor as recited in claim 1 wherein:

at least one side opening further defined as a side space between the side edge of a front panel and the back edge of the back panel; and the side closure mechanism, wherein the side opening is closed by securing a corresponding front panel to the back panel using a side closure mechanism.

3. The modular body armor as recited in claim 1 wherein a second side opening is defined by the side space between the opposite front panel and the back panel.

4. The modular body armor is recited in claim 1 wherein the protection equipment is a collar.

5. The modular body armor are recited in claim 1 wherein the protection equipment is a shoulder pad.

6. The modular armor as recited in claim 1 wherein the protection equipment is an arm protector.

7. The modular body armor is recited in claim 1 wherein the protection equipment is a groin protector.

8. The modular body armor as recited in claim 1 wherein in coupling mechanism is a mechanical attachment.

9. The modular body armor as recited in claim 1 wherein at least one front panel can overlaid and secured in multiple positions to the back panel such that the size of the vest is adjustable and provides protection to the user.

10. The modular body armor as recited in claim 9 wherein the front panel is secured to the back panel with a side closing mechanism.

11. The modular body armor as recited in claim 10 wherein the side closing mechanism is a hook and loop system.

* * * * *